US009273533B2

(12) United States Patent
Allison et al.

(10) Patent No.: US 9,273,533 B2
(45) Date of Patent: Mar. 1, 2016

(54) WELL TOOL INCLUDING SWELLABLE MATERIAL AND INTEGRATED FLUID FOR INITIATING SWELLING

(75) Inventors: David B. Allison, Duncan, OK (US); Alan B. Webb, Burleson, TX (US); Steven G. Streich, Duncan, OK (US); Christopher J. Chalker, Aberdeen (GB); Kristian Solhaug, Hafrsfjord (NO)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 12/972,438

(22) Filed: Dec. 18, 2010

(65) Prior Publication Data

US 2011/0083861 A1 Apr. 14, 2011

Related U.S. Application Data

(62) Division of application No. 11/939,968, filed on Nov. 14, 2007, now Pat. No. 7,866,408.

(30) Foreign Application Priority Data

Nov. 15, 2006 (WO) ..... PCT/US2006/060926

(51) Int. Cl.
*E21B 33/12* (2006.01)
*E21B 23/06* (2006.01)
*E21B 33/127* (2006.01)

(52) U.S. Cl.
CPC ..... *E21B 33/1208* (2013.01); *E21B 23/06* (2013.01); *E21B 33/127* (2013.01); *Y10S 277/934* (2013.01)

(58) Field of Classification Search
USPC ..... 166/386, 387, 179, 101, 187; 277/333, 277/334, 338, 934
See application file for complete search history.

(56) References Cited

U.S. PATENT DOCUMENTS 2,144,026 A 1/1939 Park
2,814,947 A 12/1957 Stegemeier et al.
(Continued)

FOREIGN PATENT DOCUMENTS

GB 2396869 A 7/2004
GB 2406593 A 4/2005
(Continued)

OTHER PUBLICATIONS

EPO Communication dated Feb. 8, 2007, containing a Letter from the Opponent dated Jan. 31, 2007, for European Patent Application No. EP 01958642.9, 2 pages.
(Continued)

*Primary Examiner* — Sean Andrish
(74) *Attorney, Agent, or Firm* — Locke Lord LLP

(57) ABSTRACT

A well tool including swellable material and integrated fluid for initiating swelling. A well tool includes a swellable material and a reservoir for containing a fluid of a type which causes the swellable material to swell. A method of swelling a swellable material included in a well tool includes the steps of: positioning the well tool in a well; and then activating a fluid to cause swelling of the swellable material. A method of swelling a swellable material includes the steps of: providing the swellable material which is capable of swelling when contacted by a fluid; positioning the swellable material in an environment in which the swellable material is contacted by another fluid which does not cause the material to swell; and swelling the swellable material by contacting the swellable material with the first fluid while the swellable material remains in contact with the other fluid.

4 Claims, 11 Drawing Sheets

(56) References Cited

U.S. PATENT DOCUMENTS

| | | | | |
|---|---|---|---|---|
| 2,849,070 | A | 8/1958 | Maly | |
| 2,945,541 | A | 7/1960 | Maly | |
| 3,099,318 | A | 7/1963 | Miller et al. | |
| 3,385,367 | A | 5/1968 | Kollsman | |
| 3,918,523 | A | 11/1975 | Stuber | |
| 4,137,970 | A | 2/1979 | Laflin et al. | |
| 4,182,677 | A | 1/1980 | Bocard et al. | |
| 4,234,197 | A | 11/1980 | Amancharla | |
| 4,240,800 | A | 12/1980 | Fischer | |
| 4,375,240 | A | 3/1983 | Baugh et al. | |
| 4,558,875 | A | 12/1985 | Yamaji et al. | |
| 4,633,950 | A | 1/1987 | Delhommer et al. | |
| 4,635,726 | A | 1/1987 | Walker | |
| 4,862,967 | A | 9/1989 | Harris | |
| 4,936,386 | A | 6/1990 | Colangelo | |
| 5,180,704 | A | 1/1993 | Reindl et al. | |
| 5,433,269 | A | 7/1995 | Hendrickson | |
| 5,523,357 | A | 6/1996 | Peterson | |
| 5,533,570 | A | 7/1996 | Streich et al. | |
| 5,718,287 | A | 2/1998 | Streich et al. | |
| 6,009,951 | A | 1/2000 | Coronado et al. | |
| 6,318,729 | B1 | 11/2001 | Pitts, Jr. et al. | |
| 6,575,251 | B2 | 6/2003 | Watson et al. | |
| 6,705,615 | B2 | 3/2004 | Milberger et al. | |
| 6,834,725 | B2 | 12/2004 | Whanger et al. | |
| 6,848,505 | B2 | 2/2005 | Richard et al. | |
| 6,938,698 | B2 | 9/2005 | Coronado | |
| 7,059,415 | B2 | 6/2006 | Bosma et al. | |
| 7,143,832 | B2 | 12/2006 | Freyer | |
| 7,234,533 | B2 | 6/2007 | Gambier | |
| 7,665,537 | B2 | 2/2010 | Patel et al. | |
| 7,690,437 | B2 | 4/2010 | Guillot et al. | |
| 7,779,907 | B2 | 8/2010 | Wagner et al. | |
| 7,866,383 | B2 | 1/2011 | Dusterhoft et al. | |
| 8,047,928 | B2 | 11/2011 | Bittner | |
| 2004/0020662 | A1 | 2/2004 | Freyer | |
| 2004/0194971 | A1 | 10/2004 | Thomson | |
| 2004/0231861 | A1 | 11/2004 | Whanger et al. | |
| 2004/0261990 | A1 | 12/2004 | Bosma et al. | |
| 2005/0023003 | A1* | 2/2005 | Echols et al. | 166/384 |
| 2005/0092485 | A1 | 5/2005 | Brezinski et al. | |
| 2005/0150661 | A1* | 7/2005 | Kenison et al. | 166/387 |
| 2005/0171248 | A1 | 8/2005 | Li et al. | |
| 2005/0199401 | A1 | 9/2005 | Patel et al. | |
| 2006/0272806 | A1 | 12/2006 | Wilkie et al. | |
| 2007/0151724 | A1 | 7/2007 | Ohmer et al. | |
| 2007/0246213 | A1 | 10/2007 | Hailey, Jr. | |
| 2007/0246225 | A1 | 10/2007 | Hailey et al. | |
| 2007/0257405 | A1 | 11/2007 | Freyer | |
| 2008/0023205 | A1 | 1/2008 | Craster et al. | |
| 2008/0110626 | A1 | 5/2008 | Allison et al. | |
| 2009/0218107 | A1 | 9/2009 | Chauffe | |
| 2010/0051294 | A1 | 3/2010 | Nutley et al. | |
| 2010/0139930 | A1 | 6/2010 | Patel et al. | |
| 2010/0155064 | A1 | 6/2010 | Nutley et al. | |
| 2010/0212883 | A1 | 8/2010 | Emerson et al. | |
| 2011/0315405 | A1 | 12/2011 | Solhaug et al. | |

FOREIGN PATENT DOCUMENTS

| | | | |
|---|---|---|---|
| GB | 2416796 | A | 2/2006 |
| GB | 2417270 | A | 2/2006 |
| GB | 2417271 | A | 2/2006 |
| GB | 2417272 | A | 2/2006 |
| GB | 2428263 | A | 1/2007 |
| GB | 2428264 | A | 1/2007 |
| JP | 2004363499 | A | 12/1992 |
| JP | 2009161686 | A | 6/1997 |
| JP | 2000064764 | A | 2/2000 |
| RU | 2157440 | C2 | 10/2000 |
| WO | 02059452 | A1 | 8/2002 |
| WO | 03008756 | A1 | 1/2003 |
| WO | 2005116394 | A1 | 12/2005 |
| WO | 2008060297 | A2 | 5/2008 |

OTHER PUBLICATIONS

International Search Report issued Nov. 13, 2001 for International Application No. PCT/NO01/000275, 3 pages.
EPO Communication of a Notice of Opposition dated Dec. 14, 2006, for European Patent Application No. EP 01958642.9, 16 pages.
Chloroprene, Kirk-Othmer Encyclopedia of Chemical Technology, 1993, title and copyright pages and p. 70, vol. 6, John Wiley & Sons publisher, New York.
The Concise Oxford Dictionary, undated, title page and pp. 148-149, 360-361, 740-741, 7th Edition, Clarendon Press, Oxford.
European Search Report issued May 18, 2006, for European Patent Application No. EP 0607543.8, 5 pages.
International Search Report and Written Opinion issued for International Patent Application No. PCT/US06/35052 dated Feb. 21, 2007 (8 pages).
International Search Report and Written Opinion issued for International Patent Application No. PCT/US07/61703 dated Mar. 21, 2008 (7 pages).
Easywell, "SwellPacker Cable", presentation given in 2006, 2 pages.
International Search Report issued for International Patent Application No. PCT/US2006/060926, dated Jun. 17, 2008, 3 pages.
Written Opinion issued for International Patent Application No. PCT/US2006/060926, dated Jun. 17, 2008, 6 pages.
U.S. Appl. No. 12/410,042, filed Mar. 24, 2009, 38 pages.
International Preliminary Report on Patentability issued Mar. 26, 2009, for International Patent Application Serial No. PCT/US07/35052, 5 pages.
International Preliminary Report on Patentability issued May 28, 2009, for International Patent Application Serial No. PCT/US06/60926, 8 pages.
Office Action issued Jun. 22, 2009, for U.S. Appl. No. 11/852,295, 16 pages.
International Preliminary Report on Patentability with Written Opinion issued Aug. 20, 2009, for International Patent Application No. PCT/US07/61703, 7 pages.
Office Action issued Dec. 3, 2009, for U.S. Appl. No. 11/852,295, 10 pages.
Office Action issued Dec. 10, 2009, for U.S. Appl. No. 11/939,968, 27 pages.
Russian Office Action issued Jan. 11, 2010, for Russian Patent Application Serial No. 2009113625, 2 pages.
English Translation of Russian Office Action issued Jan. 11, 2010, for Russian Patent Application Serial No. 2009113625, 2 pages.
Office Action issued Apr. 15, 2010, for U.S. Appl. No. 11/852,295, 7 pages.
Final Office Action issued Jun. 7, 2010, for U.S. Appl. No. 11/939,968, 17 pages.
Office Action issued Jun. 16, 2010, for U.S. Appl. No. 12/016,600, 47 pages.
Advisory Action issued Aug. 13, 2010, for U.S. Appl. No. 11/939,968, 3 pages.
International Search Report and Written Opinion issued Oct. 14, 2010, for International Application Serial No. PCT/US10/027561, 9 pages.
Office Action issued Jun. 30, 2011 for U.S. Appl. No. 12/016,600, 13 pages.
Office Action issued Mar. 15, 2011, for U.S. Appl. No. 12/410,042, 26 pages.
Office Action issued Mar. 16, 2011, for U.S. Appl. No. 12/016,600, 8 pages.
International Preliminary Report on Patentability issued Oct. 6, 2011 for International Patent Application No. PCT/US10/027561, 6 pages.
Office Action issued Dec. 19, 2011 for U.S. Appl. No. 13/197,973, 29 pages.
Office Action issued Jan. 31, 2012 for U.S. Appl. No. 12/016,600, 8 pages.
Office Action issued Apr. 9, 2012 for U.S. Appl. No. 13/303,477, 25 pages.
Office Action issued May 17, 2012 for U.S. Appl. No. 13/197,973, 9 pages.
Office Action issued Jul. 3, 2012 for U.S. Appl. No. 12/016,600, 13 pages.

(56) References Cited

OTHER PUBLICATIONS

Office Action issued Jan. 11, 2013 for U.S. Appl. No. 13/197,973, 11 pages.
Office Action issued Nov. 6, 2012 for U.S. Appl. No. 12/016,600, 13 pages.
Advisory Action issued Dec. 10, 2012 for U.S. Appl. No. 13/303,477, 23 pages.
Office Action issued Sep. 10, 2012 for U.S. Appl. No. 13/303,477, 9 pages.
Office Action issued Sep. 13, 2012 for U.S. Appl. No. 13/197,973, 5 pages.
Advisory Action issued Sep. 14, 2012 for U.S. Appl. No. 12/016,600, 7 pages.
Examiner's Answer issued Apr. 25, 2013 for U.S. Appl. No. 13/303,477, 5 pages.

* cited by examiner

WELL TOOL INCLUDING SWELLABLE MATERIAL AND INTEGRATED FLUID FOR INITIATING SWELLING

CROSS-REFERENCE TO RELATED APPLICATIONS

The present application is a division of prior application Ser. No. 11/939,968 filed on Nov. 14, 2007, which prior application claims the benefit under 35 USC §§119 and 365 of the filing date of prior International Application No. PCT/US06/60926, filed Nov. 15, 2006. The entire disclosures of these prior applications are incorporated herein by this reference.

BACKGROUND

The present invention relates generally to equipment utilized and operations performed in conjunction with a subterranean well and, in an embodiment described herein, more particularly provides a well tool including a swellable material and an integrated fluid for initiating swelling of the swellable material.

Well packers and other types of well tools are known which use swellable materials. These swellable materials swell when they are contacted by a certain type of fluid. For example, a swellable material may swell when it is contacted by a hydrocarbon fluid, gas, water, etc.

If the particular fluid which causes swelling of the swellable material is not present in a well when it is desired for the material to swell, then the fluid can be circulated through the well to the material, for example, by spotting the fluid at the depth of the well tool.

Unfortunately, this method has certain disadvantages. For example, the fluid can migrate away from the well tool (e.g., if the fluid which causes the swellable material to swell has a different density or viscosity as compared to the remainder of the fluid in the well), and over the longer term the fluid will not be present to maintain the swollen condition of the swellable material.

Therefore, it may be seen that improvements are needed in the art of constructing well tools utilizing swellable materials, and swelling those materials in conjunction with well operations.

SUMMARY

In carrying out the principles of the present invention, well tools and associated methods are provided which solve at least one problem in the art. One example is described below in which a well tool is provided with an integral fluid reservoir for supplying fluid to a swellable material. Another example is described below in which fluid is supplied to a swellable material of a well tool to cause the material to swell while the material is in an environment containing another fluid which does not cause the material to swell.

In one aspect, a well tool is provided which includes a swellable material and a reservoir for containing a fluid of a type which causes the first swellable material to swell. Preferably, the reservoir is included as an integral part of the well tool, either by being internal to the swellable material, or by being positioned adjacent to the swellable material.

In another aspect, a method of swelling a swellable material included in a well tool is provided. The method includes the steps of: positioning the well tool in a well; and then activating a fluid to cause swelling of the swellable material. The fluid may be activated in various different ways, for example, by passage of time, by varying pressure, increasing temperature, applying force, etc.

In yet another aspect, a method of swelling a swellable material includes the steps of: providing the swellable material which is capable of swelling when contacted by a fluid; positioning the swellable material in an environment in which the swellable material is contacted by another fluid which does not cause the material to swell; and swelling the swellable material by contacting the swellable material with the first fluid while the swellable material remains in contact with the other fluid.

These and other features, advantages, benefits and objects of the present invention will become apparent to one of ordinary skill in the art upon careful consideration of the detailed description of representative embodiments of the invention hereinbelow and the accompanying drawings, in which similar elements are indicated in the various figures using the same reference numbers.

DETAILED DESCRIPTION

It is to be understood that the various embodiments of the present invention described herein may be utilized in various orientations, such as inclined, inverted, horizontal, vertical, etc., and in various configurations, without departing from the principles of the present invention. The embodiments are described merely as examples of useful applications of the principles of the invention, which is not limited to any specific details of these embodiments.

In the following description of the representative embodiments of the invention, directional terms, such as "above", "below", "upper", "lower", etc., are used for convenience in referring to the accompanying drawings. In general, "above", "upper", "upward" and similar terms refer to a direction toward the earth's surface along a wellbore, and "below", "lower", "downward" and similar terms refer to a direction away from the earth's surface along the wellbore.

Figure 1:
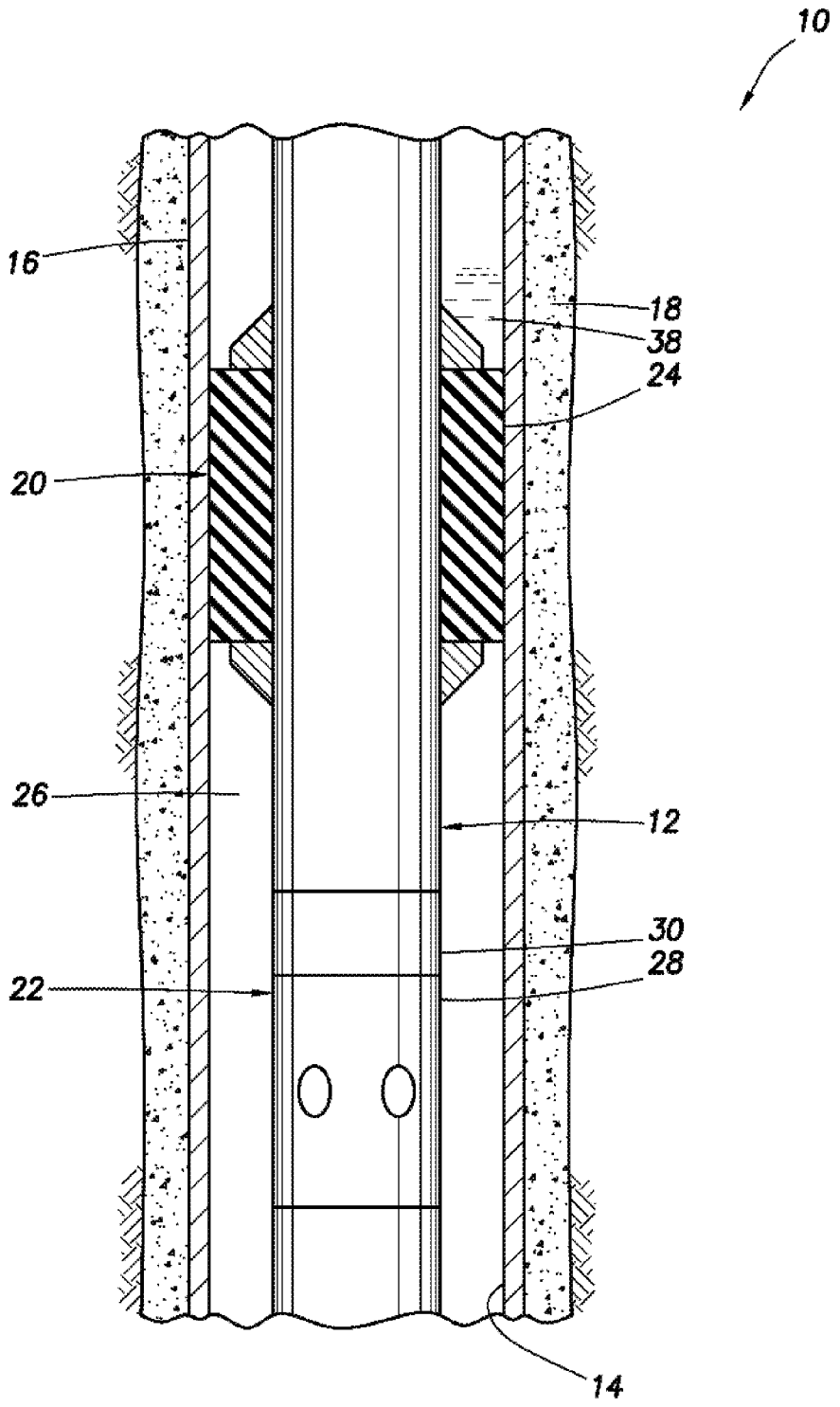
FIG. 1 is a schematic partially cross-sectional view of a well system and associated method embodying principles of the present invention.

Representatively illustrated in FIG. 1 is a well system 10 and associated method which embody principles of the present invention. In the well system 10, a tubular string 12 is installed in a wellbore 14. In this example, the wellbore 14 is lined with casing 16 and cement 18, but the wellbore could instead be unlined or open hole in other embodiments.

The tubular string 12 includes well tools 20 and 22. The well tool 20 is depicted as being a packer assembly, and the well tool 22 is depicted as being a valve or choke assembly. However, it should be clearly understood that these well tools 20, 22 are merely representative of a variety of well tools which may incorporate principles of the invention.

The well tool 20 includes a swellable material 24 for use as an annular seal to selectively prevent flow through an annulus 26 formed between the tubular string 12 and the casing 16. Swellable materials may be used as seals in other types of well tools in keeping with the principles of the invention.

For example, another type of swellable seal is described in U.S. application Ser. No. 11/407,848, filed Apr. 20, 2006 for regulating flow through a well screen. The entire disclosure of this prior application is incorporated herein by this reference.

The well tool 22 includes a flow control device 28 (such as a valve or choke, etc.) and an actuator 30 for operating the flow control device. Swellable materials may be used in other types of actuators for operating other types of well tools.

For example, actuators using swellable materials for operating well tools are described in U.S. application Ser. No. 11/407,704, filed Apr. 20, 2006. The entire disclosure of this prior application is incorporated herein by this reference.

The swellable material used in the well tools 20, 22 swells when contacted by an appropriate fluid. The term "swell" and similar terms (such as "swellable") are used herein to indicate an increase in volume of a swellable material.

Typically, this increase in volume is due to incorporation of molecular components of the fluid into the swellable material itself, but other swelling mechanisms or techniques may be used, if desired. Note that swelling is not the same as expanding, although a seal material may expand as a result of swelling.

For example, in some conventional packers, a seal element may be expanded radially outward by longitudinally compressing the seal element, or by inflating the seal element. In each of these cases, the seal element is expanded without any increase in volume of the seal material of which the seal element is made. Thus, in these conventional packers, the seal element expands, but does not swell.

The fluid which causes swelling of the swellable material could be water and/or hydrocarbon fluid (such as oil or gas). The fluid could be a gel or a semi-solid material, such as a hydrocarbon-containing wax or paraffin which melts when exposed to increased temperature in a wellbore. In this manner, swelling of the material could be delayed until the material is positioned downhole where a predetermined elevated temperature exists. The fluid could cause swelling of the swellable material due to passage of time.

Various swellable materials are known to those skilled in the art, which materials swell when contacted with water and/or hydrocarbon fluid, so a comprehensive list of these materials will not be presented here. Partial lists of swellable materials may be found in U.S. Pat. Nos. 3,385,367 and 7,059,415, and in U.S. Published Application No. 2004-0020662, the entire disclosures of which are incorporated herein by this reference.

The swellable material may have a considerable portion of cavities which are compressed or collapsed at the surface condition. Then, when being placed in the well at a higher pressure, the material is expanded by the cavities filling with fluid.

This type of apparatus and method might be used where it is desired to expand the material in the presence of gas rather than oil or water. A suitable swellable material is described in International Application No. PCT/NO2005/000170 (published as WO 2005/116394), the entire disclosure of which is incorporated herein by this reference.

It should, thus, be clearly understood that any swellable material which swells when contacted by any type of fluid may be used in keeping with the principles of the invention.

Figure 2:
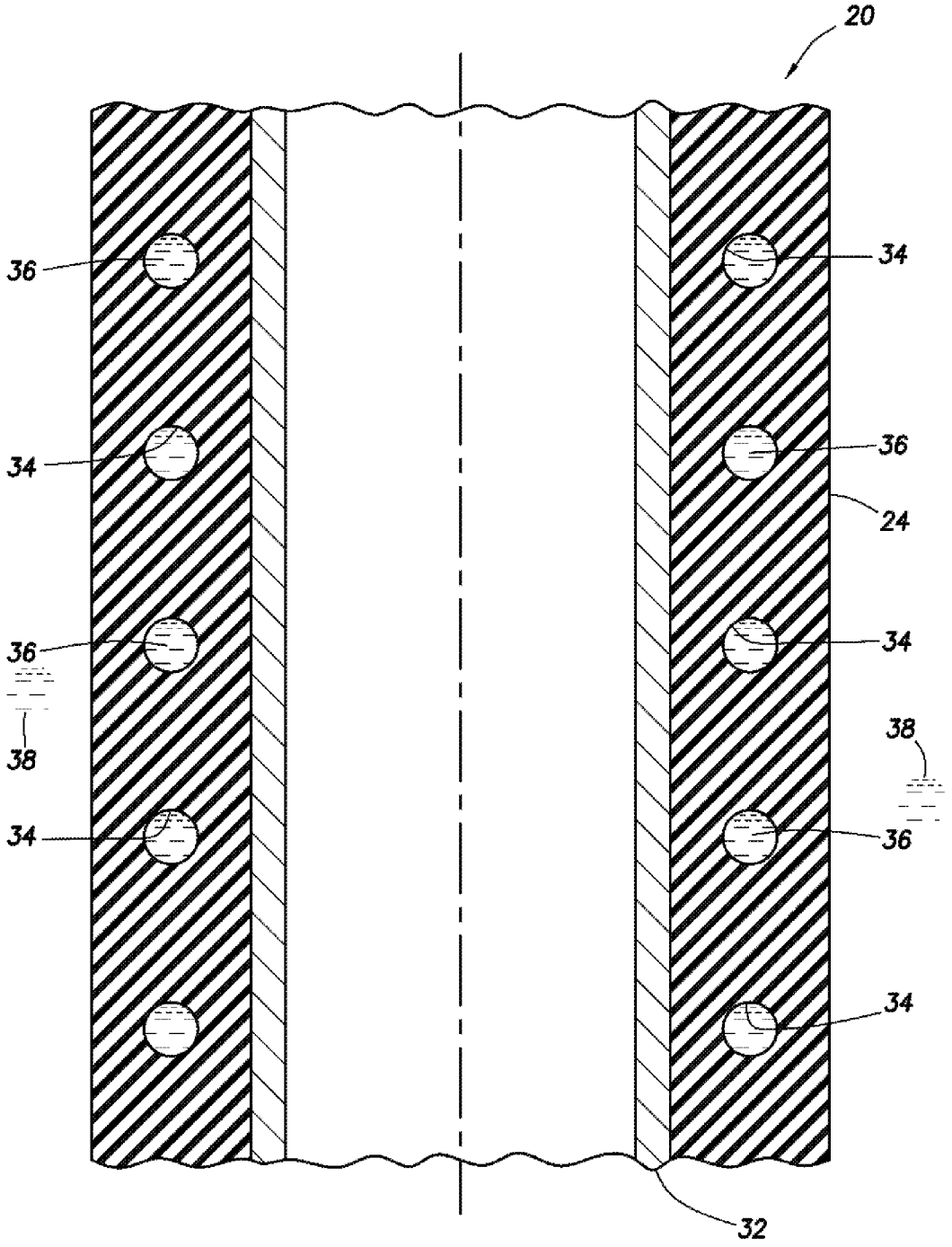
FIGS. 2-18 are schematic cross-sectional views of alternate configurations of well tools for use in the well system of FIG. 1.

Referring additionally now to FIG. 2, an enlarged scale schematic cross-sectional view of one possible configuration of the well tool 20 is representatively illustrated. The well tool 20 is used for convenience to demonstrate how the principles of the invention may be beneficially incorporated into a particular well tool, but any other type of well tool may utilize the principles of the invention to enable swelling of a swellable material of the well tool.

As depicted in FIG. 2, the swellable material 24 is positioned on a generally tubular mandrel 32. The swellable material 24 could, for example, be adhesively bonded to the mandrel 32, or the swellable material could be otherwise secured and sealed to the mandrel.

Multiple relatively small reservoirs 34 are formed internally within the swellable material 24. Although the reservoirs 34 are illustrated in FIG. 2 as being spherical in shape, the reservoirs 34 may be formed as cavities having any desired shape.

The reservoirs 34 may be formed when the swellable material 24 is manufactured, or they may be formed in the material afterward. The reservoirs 34 could extend longitudinally, circumferentially, radially, or in any other direction or combination of directions.

The reservoirs 34 each contain a fluid 36 which causes the material 24 to swell. In this manner, the material 24 may be externally in contact with another fluid 38 which does not cause the material to swell, but the material will still swell because the fluid 36 is internally available to the material.

For example, in the well system 10 of FIG. 1, the annulus 26 may be filled with the fluid 38 which does not cause the material 24 to swell. However, the material 24 can still be made to swell due to the fluid 36 being in contact with the material.

In one embodiment, the fluid 36 could initially be in a solid form, such as a wax or paraffin, and after the well tool 20 is installed in the well the increased temperature in the well will melt and liquefy the wax or paraffin, so that it is available to cause swelling of the material 24.

In another embodiment, the fluid 36 could be a gas, and after the well tool 20 is installed in the well the increased pressure in the well will cause the gas to penetrate and swell the material 24.

In any of these embodiments, the fluid 36 and/or material 24 may be designed so that the fluid 36 causes swelling of the material upon passage of a predetermined amount of time.

Of course, other types of fluids may be used in the well tool 20 of FIG. 2 in keeping with the principles of the invention. Furthermore, any number and size of the reservoirs 34 may be used to contain the fluid 36.

Figure 3:
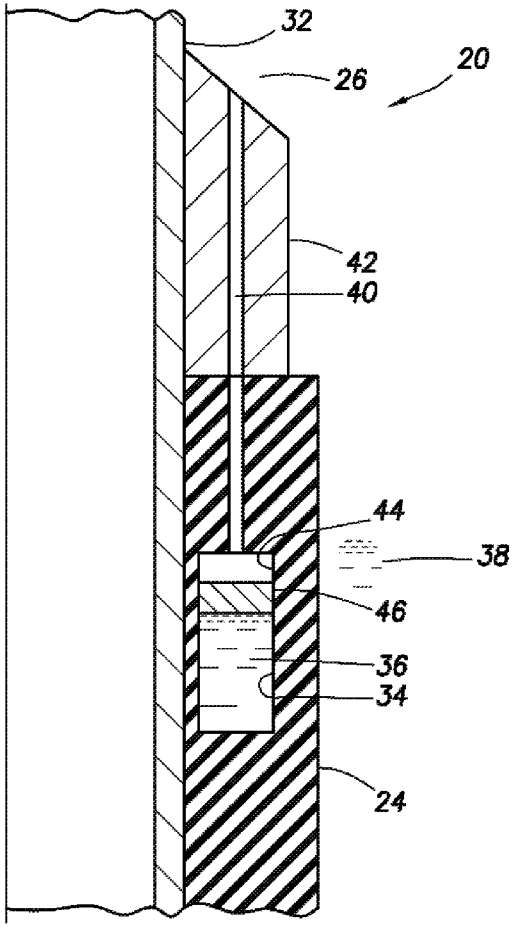

Referring additionally now to FIG. 3, an alternate configuration of the well tool 20 is representatively illustrated. In this configuration, only a single reservoir 34 is used, with the reservoir being formed as an internal chamber in the swellable material 24. Another difference between the configurations of FIGS. 2 & 3 is that the FIG. 3 configuration includes a way to apply annular pressure to the reservoir 34 and compensate for dissipation of the fluid 36 into the material 24.

A passage 40 is formed through the material 24 and an end ring 42. The passage 40 provides for fluid communication between the annulus 26 and another chamber 44 formed in the material 24.

A pressure equalizing device 46 (such as a floating piston, a membrane, etc.) separates the annulus fluid 38 from the fluid 36 in the reservoir 34, while transmitting pressure from the annulus 26 to the reservoir. In this manner, pressure in the annulus 26 is available to pressurize the fluid 36 and "drive" the fluid into the material 24 if needed, and the fluid 38 can enter the chamber 44 as the fluid 36 dissipates into the material 24.

Figure 4:
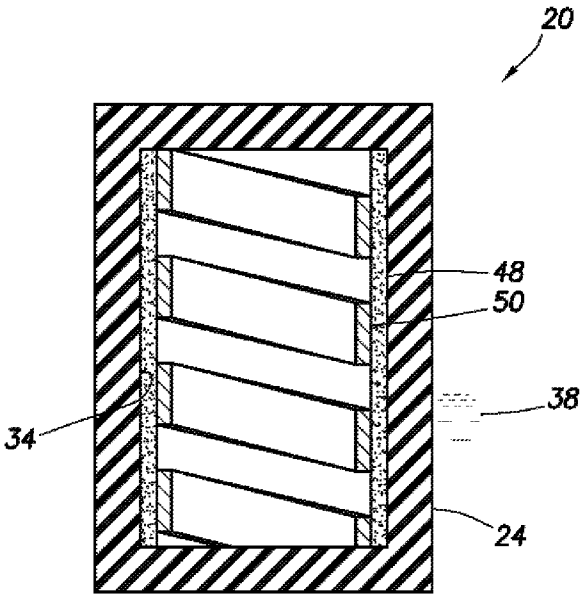

Referring additionally now to FIG. 4, a portion of the swellable material 24 is representatively illustrated in further enlarged scale from another alternate configuration of the well tool 20. The portion of the swellable material 24 illustrated in FIG. 4 includes the reservoir 34 which, in this embodiment, does not include the pressure transmitting and equalizing features described above for the configuration of FIG. 3.

Instead, the configuration of FIG. 4 includes features which prevent collapse or other deformation of the reservoir 34 when the fluid 36 is dissipated into the material 24. For this purpose, a porous material 48 (such as a wire mesh) is positioned between the material 24 and a support structure 50 (such as a helically wound flat wire spring) in the reservoir 34.

The porous material 48 permits the fluid 36 (not shown in FIG. 4) to contact the material 24, but prevents extrusion of the material between the wraps of the support structure 50. The structure 50 prevents deformation of the reservoir 34 as the fluid 36 dissipates into the material 24.

Of course, other types of porous materials and support structures may be used in keeping with the principles of the invention. Furthermore, porous materials and support structures may be used in the other configurations of the well tool 20 described herein, for example, in the reservoir 34 in the configuration of FIG. 3.

Figure 5:
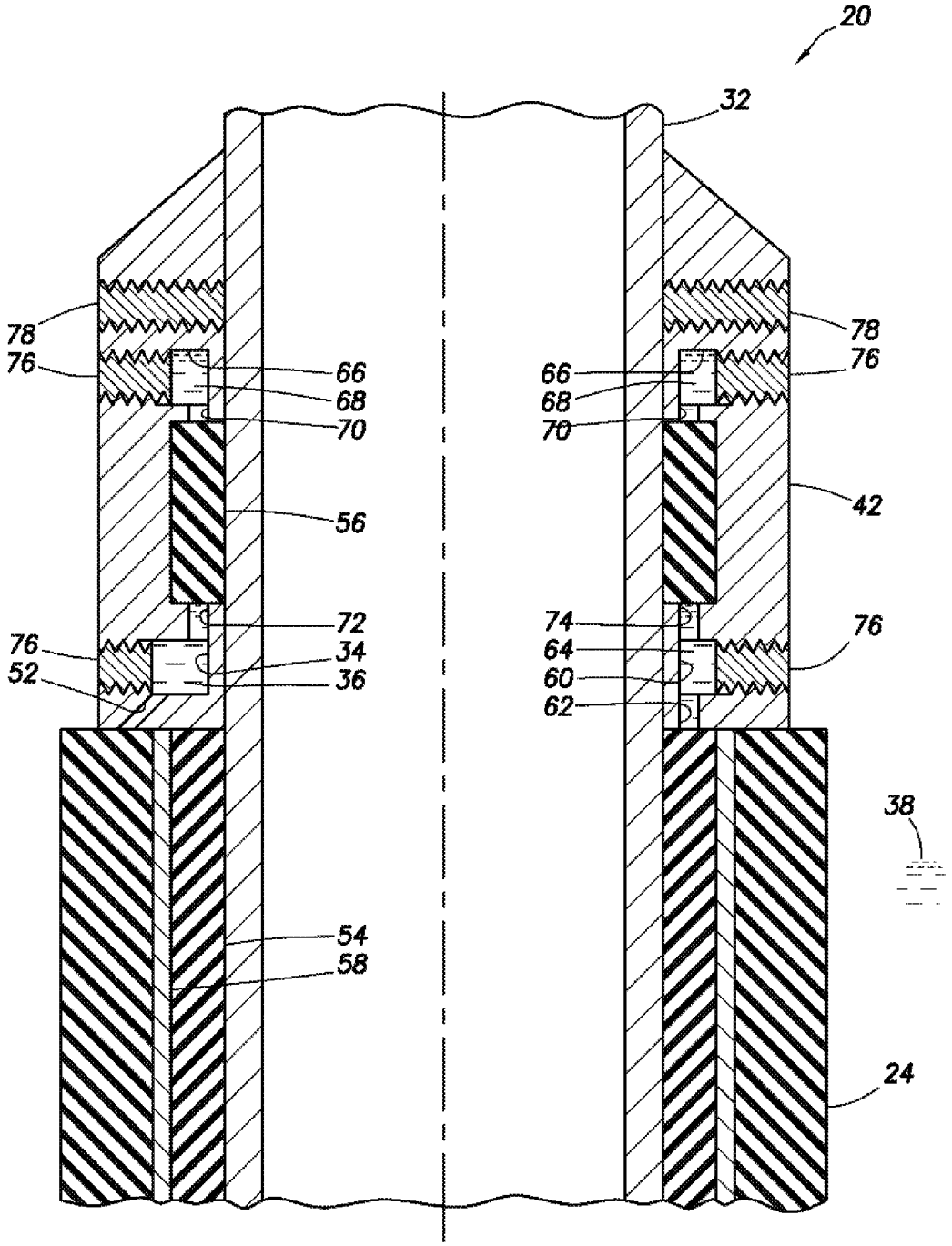

Referring additionally now to FIG. 5, another alternate configuration of the well tool 20 is representatively illustrated. In this configuration, the reservoir 34 is positioned in the end ring 42, and a passage 52 is formed to provide fluid communication between the reservoir and the swellable material 24.

Another difference in the configuration of FIG. 5 is that the well tool 20 includes additional swellable materials 54, 56. The swellable material 54 provides sealing between a generally tubular sleeve 58 and the mandrel 32, and the swellable material 56 provides sealing between the end ring 42 and the mandrel.

The swellable materials 54, 56 may be made of the same material as the swellable material 24, or one or both of the materials 54, 56 may be different from the material 24. The swellable materials 24, 54 and the sleeve 58 may be installed on the mandrel 32 in the manner described in International Application No. PCT/US06/035052, filed Sep. 11, 2006, entitled Swellable Packer Construction, having Agent File Reference 021385U1PCT (which corresponds to U.S. application Ser. No. 11/852,295 filed Sep. 8, 2007), and the entire disclosure of which is incorporated herein by this reference.

If the swellable material 54 is different from the swellable material 24 or 56, then one or more separate reservoirs 60 may be used to contain an appropriate fluid 64 for causing swelling of the material 54. A passage 62 may provide fluid communication between the reservoir 60 and the swellable material 54.

Similarly, if the swellable material 56 is different from the swellable material 24 or 54, then one or more separate reservoirs 66 may be used to contain an appropriate fluid 68 for causing swelling of the material 56. A passage 70 may provide fluid communication between the reservoir 66 and the swellable material 56.

Preferably, the swellable materials 24, 54, 56 are made of the same type of material, and the fluids 36, 64, 68 are the same type of fluid. Accordingly, note that in FIG. 5 additional passages 72, 74 are provided to permit fluid communication between the reservoirs 36, 64 and the swellable material 56.

Plugs 76 may be provided to enable filling the reservoirs 34, 60, 66 in the end ring 42. Set screws 78 (such as carbide-tipped set screws) may be provided to secure the end ring 42 to the mandrel 32.

Figure 7:
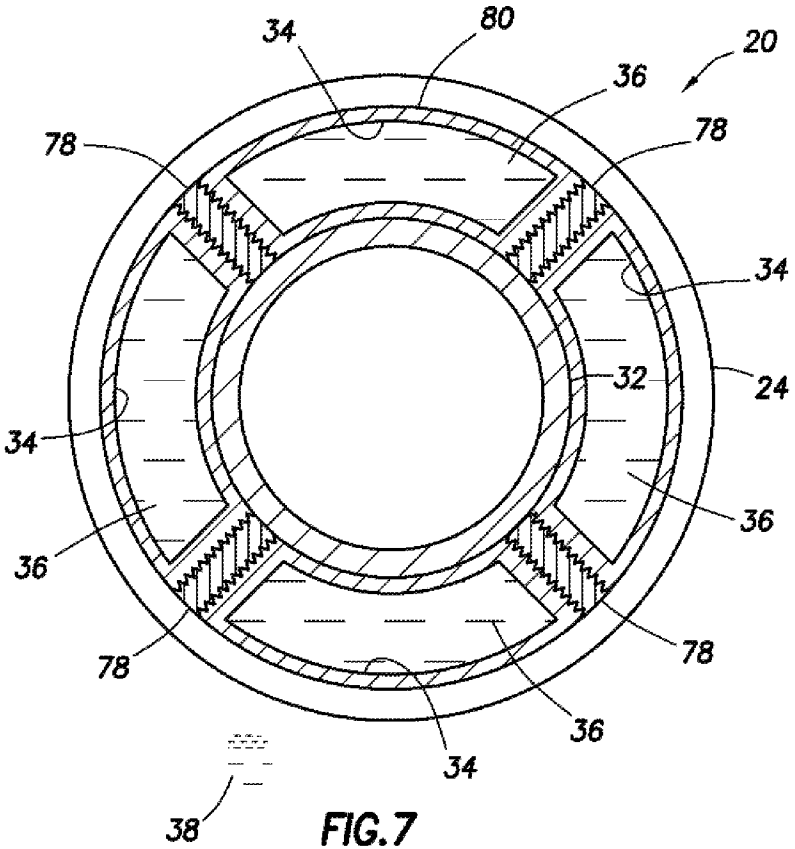
Figure 6:
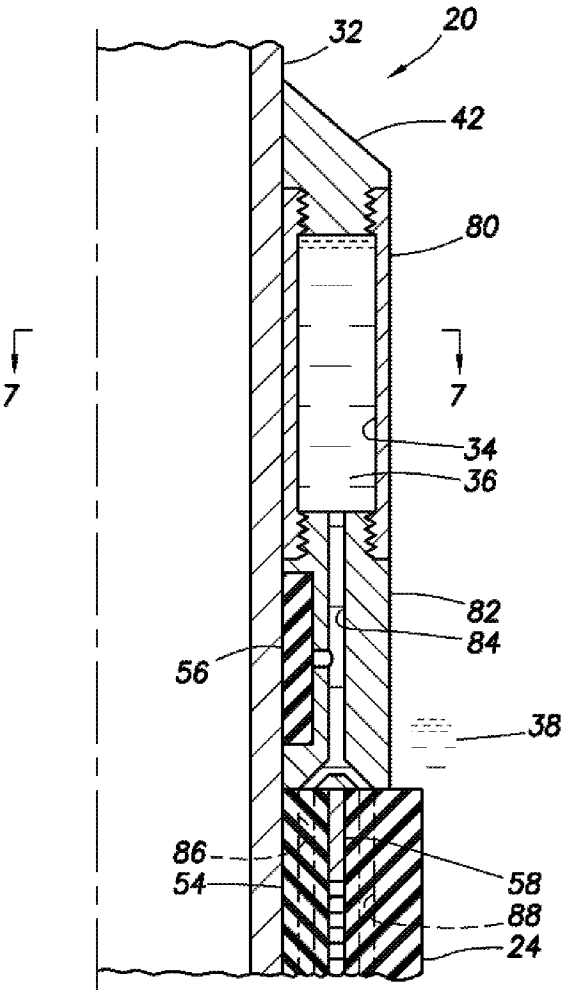

Referring additionally now to FIGS. 6 & 7, another alternate configuration of the well tool 20 is representatively illustrated. In this configuration, multiple reservoirs 34 are formed in a housing 80 threadedly attached between the end ring 42 and another housing 82 having the swelling material 56 therein.

A cross-sectional view of the housing 80 is representatively illustrated in FIG. 7. In this view, it may be seen that four of the reservoirs 36 are formed in the housing 80, and that the set screws 78 are installed through the housing between the reservoirs. Of course, any number of reservoirs 34 may be used in keeping with the principles of the invention.

In this embodiment, the swellable materials 24, 54, 56 are made of the same type of material, and so in FIG. 6 it may be seen that one or more passages 84 provide fluid communication between the reservoirs 34 and each of the swellable materials. However, if the swellable materials 24, 54, 56 required different fluids 36, 64, 68 to cause swelling of respective different materials, then separate passages could be provided between the materials and separate reservoirs containing the respective different fluids.

Furthermore, note that although separate passages 86, 88 are formed in the swellable materials 54, 24 for communication with the passage 84 on either side of the sleeve 58, the sleeve is also perforated to allow fluid communication through the sleeve. This feature could also be incorporated into any of the other configurations of the well tool 20 described herein.

Figure 9:
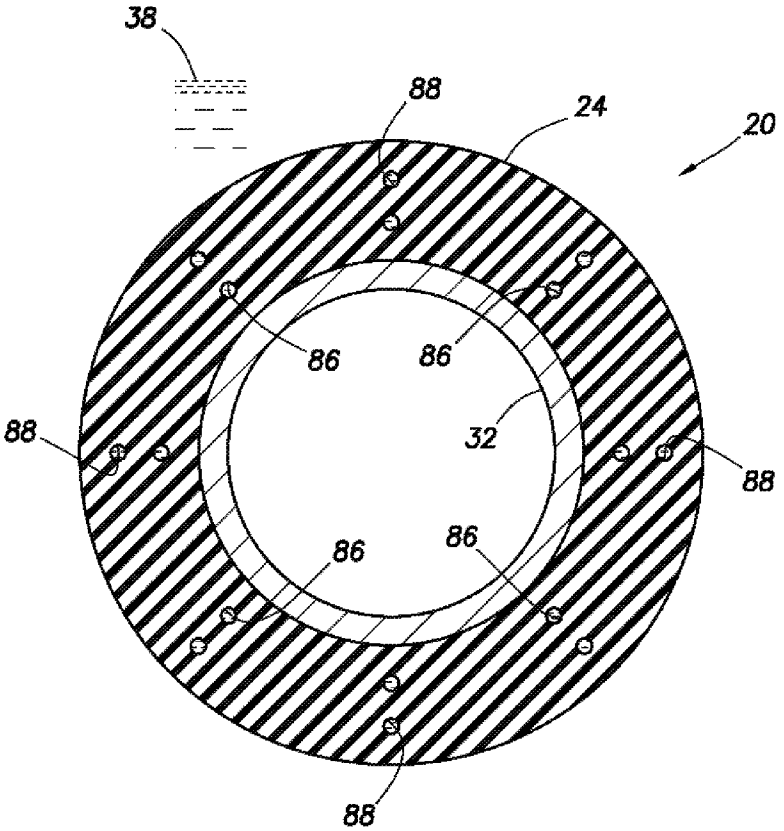
Figure 8:
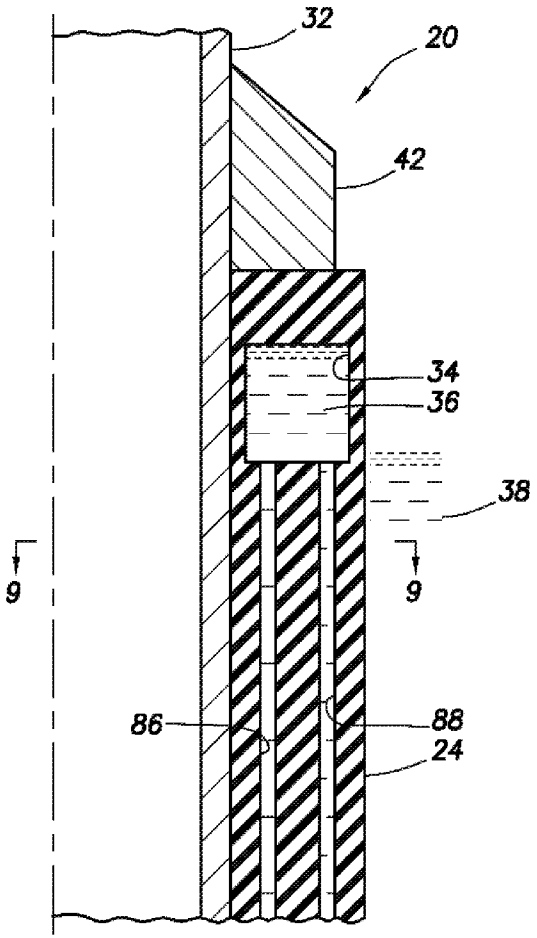

Referring additionally now to FIGS. 8 & 9, another alternate configuration of the well tool 20 is representatively illustrated. In this configuration, the reservoir 34 is formed as an annular chamber within the interior of the swellable material 24. The passages 86, 88 extend into the swellable material 24 to provide adequate distribution of the fluid 36 to the material.

As depicted in FIG. 9, a series of the passages 86, 88 are circumferentially distributed in the swellable material 24. Eight of each of the passages 86, 88 are shown in FIG. 9, but any number or arrangement of the passages may be used in keeping with the principles of the invention. In addition, the passages 86, 88 may extend any distance in the material.

Figure 11:
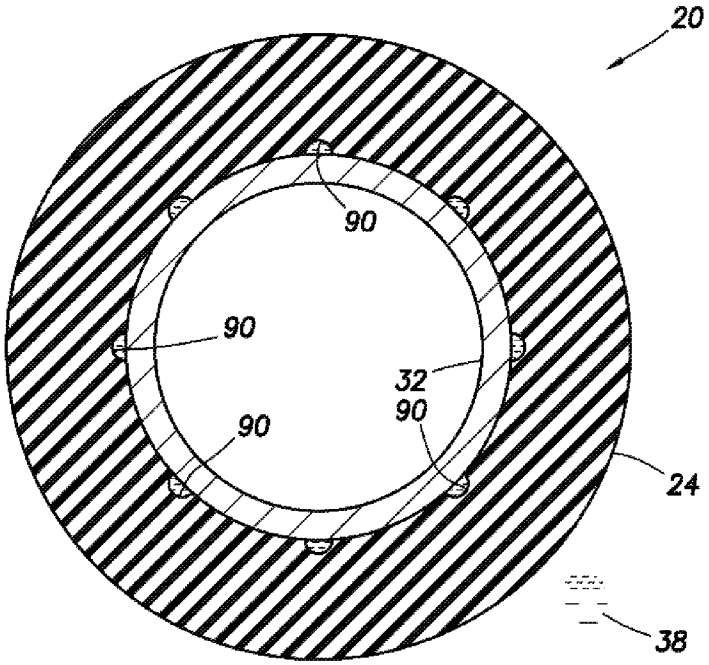
Figure 10:
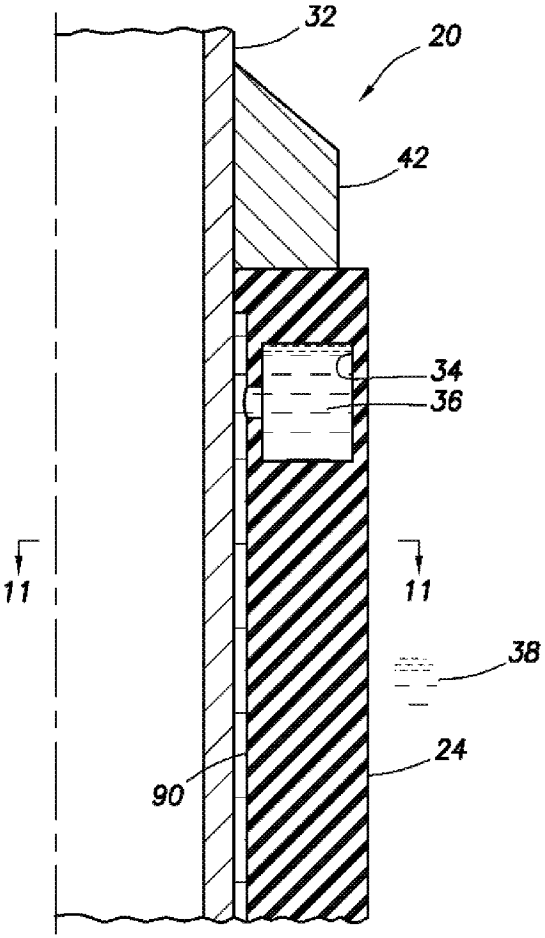

Referring additionally now to FIGS. 10 & 11, another alternate configuration of the well tool 20 is representatively illustrated. This configuration is similar in many respects to the configuration of FIGS. 8 & 9, except that passages 90 which provide fluid communication between the reservoir 34 and the swellable material 24 are formed only partially in the material.

The passages 90 are also bounded radially inwardly by the mandrel 32. Note that the passages 90 could also, or alternatively, be formed on or in the mandrel 32, if desired.

Figure 12:
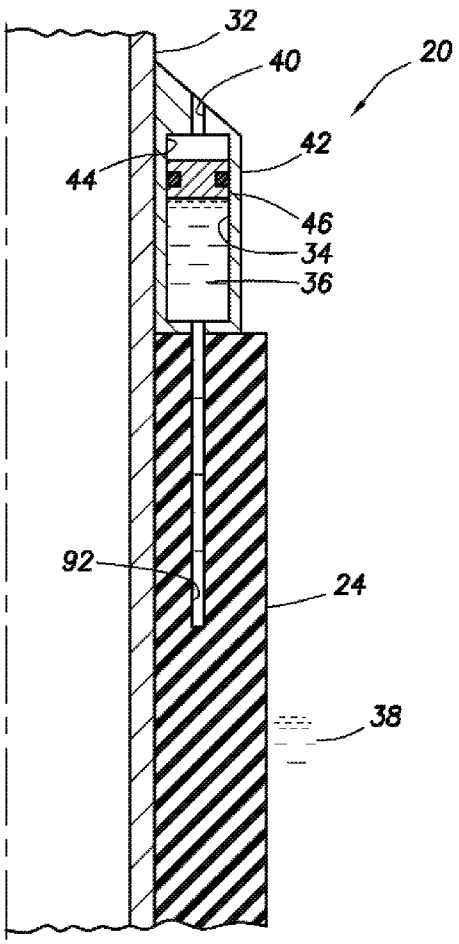

Referring additionally now to FIG. 12, another alternate configuration of the well tool 20 is representatively illustrated. In this configuration, the reservoir 34 is formed in the end ring 42 and the pressure equalizing device 46 separates the reservoir from the chamber 44 which is also formed in the end ring.

The configuration of FIG. 12 is somewhat similar to the configuration of FIG. 3, except that the reservoir 34 and chamber 44 are formed in the end ring 42, instead of in the swellable material 24. Accordingly, one or more passages 92 are used to provide fluid communication between the reservoir 34 and the interior of the swellable material 24. The passages 92 may extend any distance into the material 24.

Figure 13:
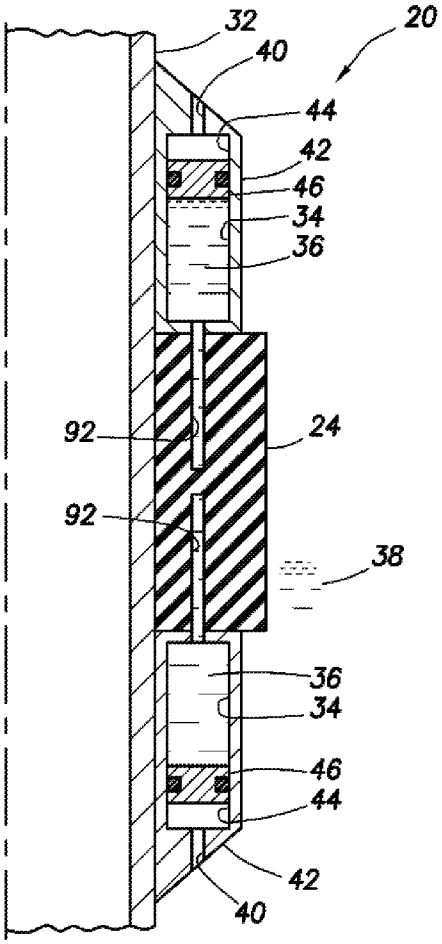

Referring additionally now to FIG. 13, another alternate configuration of the well tool 20 is representatively illustrated. This configuration is very similar to the configuration of FIG. 12, except that two sets of the end rings 42 with the reservoir 34 and chamber 44 therein are used, with one at each opposite end of the swellable material 24.

Figure 14:
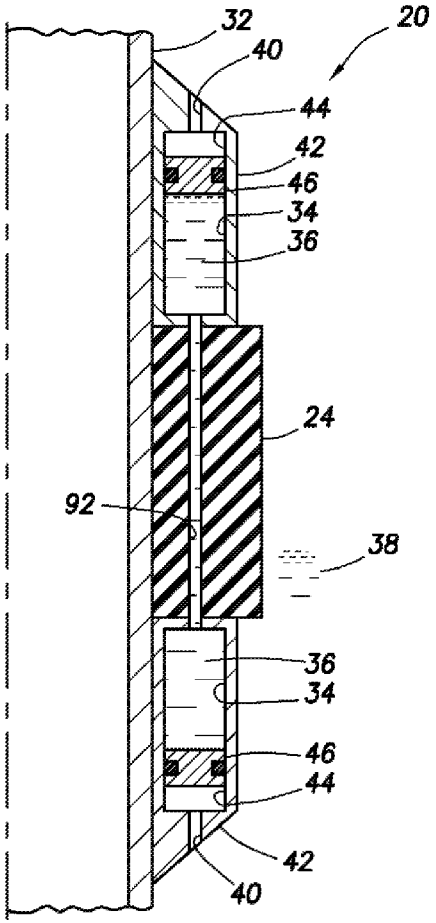

Referring additionally now to FIG. 14, another alternate configuration of the well tool 20 is representatively illustrated. This configuration is very similar to the configuration of FIG. 13, except that the passages 92 are formed completely through the swellable material 24 and interconnect the reservoirs 34.

Figure 15:
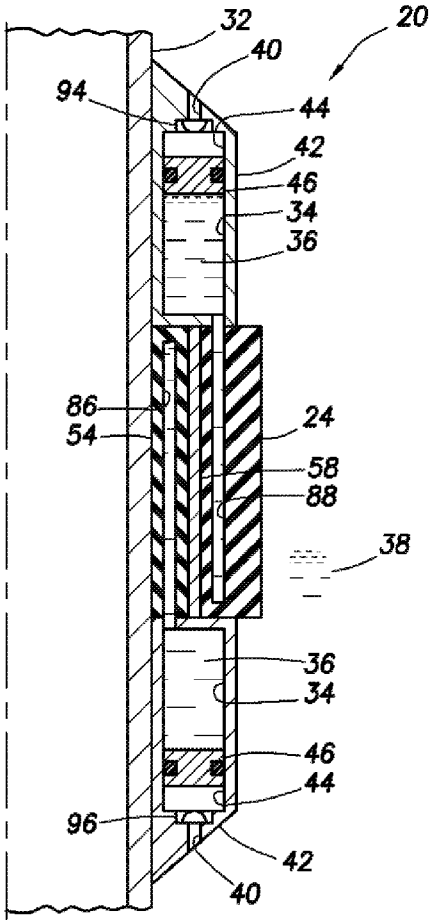

Referring additionally now to FIG. 15, another alternate configuration of the well tool 20 is representatively illustrated. This configuration is very similar to the configuration of FIGS. 13 & 14, except that the upper reservoir 34 is used to supply the fluid 36 to the swellable material 24, and the lower reservoir 34 is used to supply the fluid 36 to the swellable material 54 separated from the material 24 by the sleeve 58 (as in the configurations of FIGS. 5 & 6).

Of course, if the material 24 is different from the material 54 then different fluids 36, 64 may be used to cause swelling of the respective materials, as described above.

Another difference in the configuration of FIG. 15 is that flow control devices 94, 96 are used to determine when the reservoirs 36 are pressurized by the fluid 38 in the annulus 26. As depicted in FIG. 15, the flow control devices 94, 96 are in the form of rupture discs which rupture when a predetermined pressure is applied to the annulus 26, but other types of flow control devices (such as valves, eutectic devices which melt at a predetermined temperature, flow control devices such as sliding sleeves which operate in response to application of mechanical force, etc.) may be used in keeping with the principles of the present invention.

Figure 16:
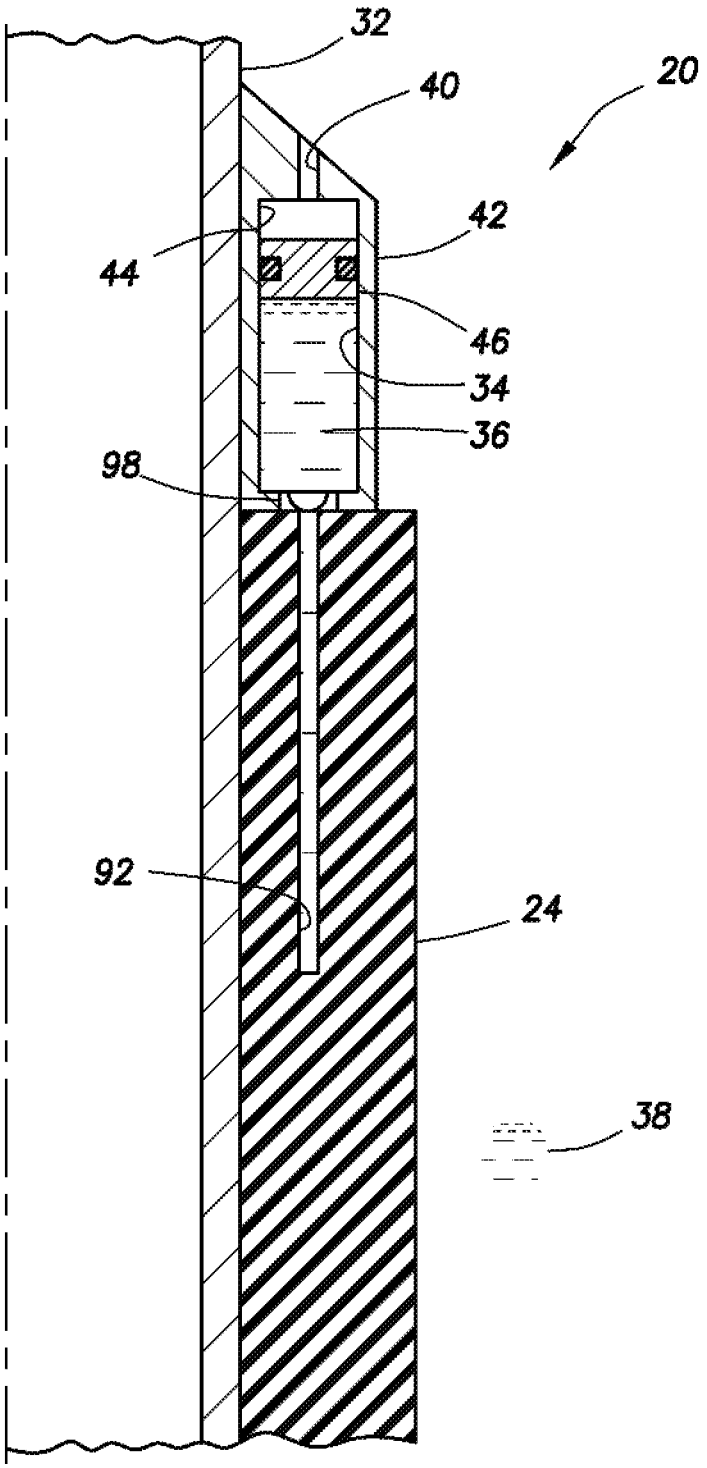

Referring additionally now to FIG. 16, another alternate configuration of the well tool 20 is representatively illustrated. In this configuration, a flow control device 98 (similar to the flow control devices 94, 96 described above) is positioned between the reservoir 34 and the passage 92.

In this manner, the fluid 36 is not permitted to contact the material 24 until the flow control device 98 is opened. This allows swelling of the material 24 to be delayed until such swelling is desired (for example, after the well tool 20 has been appropriately positioned downhole in a well), at which time a predetermined pressure, temperature, force, etc. may be applied to cause the flow control device 98 to open and permit fluid communication between the reservoir 34 and the interior of the material.

Note that the flow control devices 94, 96, 98 depicted in FIGS. 15 & 16 may be used in any of the other configurations of the well tool 20 described herein to control application of pressure to the reservoir 34, and/or to control fluid communication between the reservoir and the swellable material 24 or a passage in communication with the material.

Figure 17:
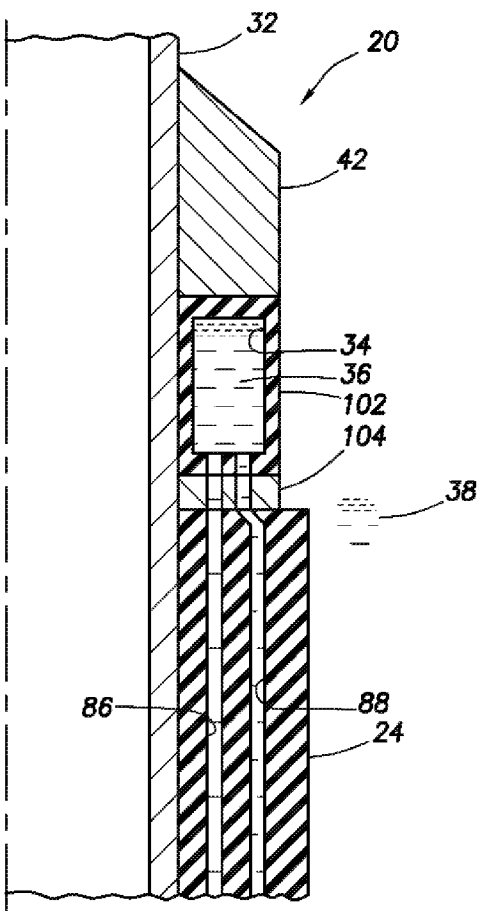

Referring additionally now to FIG. 17, another alternate configuration of the well tool 20 is representatively illustrated. This configuration is similar in many respects to the configuration of FIG. 8. However, in the configuration of FIG. 17, the reservoir 34 is collapsible, in order to allow for pressure equalization between the interior of the reservoir and the exterior of the tool 20 as the fluid 36 is dispersed into the material 24.

To permit the reservoir 34 to collapse, an outer wall 102 of the reservoir is relatively thin and flexible. The outer wall 102, thus, functions as a flexible membrane and pressure equalizing device between the reservoir 34 and the exterior of the tool 20.

As the fluid 36 is dispersed into the material 24, the outer wall 102 will deflect inward, thereby allowing the volume of the reservoir 34 to decrease without creating a "negative" pressure differential which would hinder further dispersal of the fluid into the material. A rigid wall 104 is preferably provided between the reservoir 34 and the material 24, so that collapse of the reservoir is unaffected by the swelling of the material and vice versa.

Figure 18:
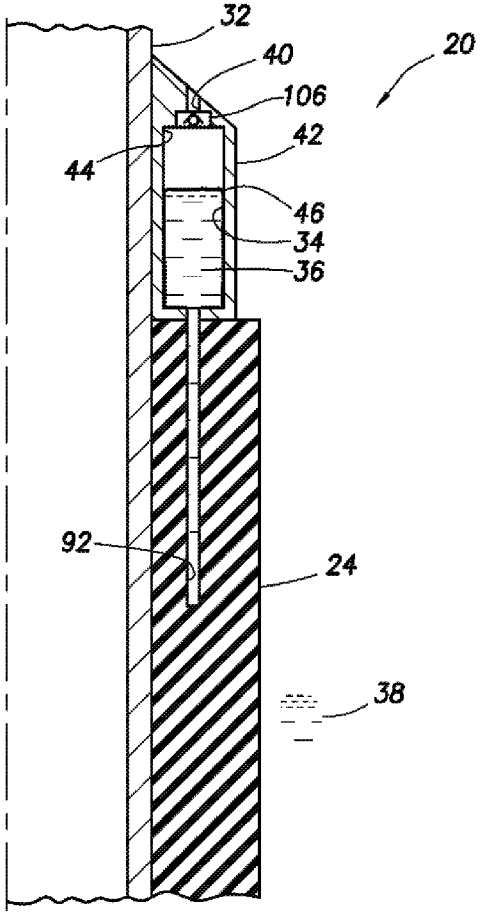

Referring additionally now to FIG. 18, another alternate configuration of the well tool 20 is provided in which the reservoir 34 is collapsible. This configuration is similar in many respects to the configuration of FIG. 12. However, in the configuration of FIG. 18, the pressure equalization device 46 is not a piston, but instead is a flexible membrane or bag in which the fluid 36 is contained.

As the fluid 36 is dispersed into the material 24, the device 46 collapses, thereby allowing the volume of the reservoir 34 to decrease without creating a "negative" pressure differential which would hinder further dispersal of the fluid into the material. A flow control device 106 is provided to regulate flow into the chamber 44. The flow control device 106 could be, for example, a check valve (such as a spring-loaded check valve, flexible sealing washer, etc.), another type of one-way valve (such as a one-way lip seal), a one-way pressure equalizing valve, etc.

It may now be fully appreciated that the well tool 20 described above in its various configurations provides for swelling of the swellable materials 24, 54, 56, even though the materials are positioned in an environment in which the fluid 38 therein does not cause swelling of the materials. The well tool 20 includes at least one swellable material 24 and at least one reservoir 34 for containing a fluid 36 of a type which causes the swellable material to swell. The fluid 36 is at least one of a gas, gel, liquid, hydrocarbon fluid and water. The fluid 36 could be a solid material which liquefies at a predetermined elevated temperature. The reservoir 34 is in fluid communication with the swellable material 24.

The reservoir 34 may be collapsible. A flow control device 106 may equalize pressure between an interior of the reservoir 34 and a pressure source exterior to the reservoir.

A flow control device 98 may selectively permit fluid communication between the reservoir 34 and the swellable material 24. The reservoir 34 may be positioned within the swellable material 24, or the reservoir may be positioned external to the swellable material.

The well tool 20 may include a second reservoir 34, 60, 66. The second reservoir may also contain the fluid 36, or it may contain another type of fluid 64, 68. The second reservoir may be fluid communicable with the swellable material 24, or with another swellable material 54, 56.

The fluid 36 may be activated to cause the swellable material 24 to swell in response to passage of time or application of at least one of heat, pressure and force. The fluid 36 may be operable to cause the swellable material 24 to swell when the well tool 20 is immersed in another fluid 38 which does not cause the swellable material to swell. The swellable material 24 may be included in an actuator 30 of a well tool 22, so that swelling of the swellable material is operable to actuate the well tool.

Of course, a person skilled in the art would, upon a careful consideration of the above description of representative embodiments of the invention, readily appreciate that many modifications, additions, substitutions, deletions, and other changes may be made to the specific embodiments, and such changes are contemplated by the principles of the present invention. Accordingly, the foregoing detailed description is to be clearly understood as being given by way of illustration and example only, the spirit and scope of the present invention being limited solely by the appended claims and their equivalents.

What is claimed is:

1. A well tool, comprising:

a first swellable material;

a first reservoir which contains a first fluid which causes the first swellable material to swell;

a second swellable material; and a second reservoir, wherein the second reservoir contains a second fluid which is different from the first fluid and which causes the second swellable material to swell.

2. The well tool of claim 1, wherein the second reservoir is in fluid communication with the second swellable material.

3. A method of swelling a first swellable material included in a well tool, the method comprising the steps of:

positioning the well tool in a well; and then activating a fluid to cause swelling of the first swellable material, wherein the activating step further comprises providing fluid communication between a first reservoir and the first swellable material, and wherein the well tool further comprises a second reservoir and a second swellable material, and wherein the activating step further comprises providing fluid communication between the second reservoir and the second swellable material.

4. A method of swelling a first swellable material of a well tool, the method comprising the steps of:

providing the first swellable material which is capable of swelling when contacted by a first fluid;

positioning the first swellable material in an environment in which the first swellable material is contacted by a second fluid which does not cause the material to swell; and swelling the first swellable material by contacting the first swellable material with the first fluid while the first swellable material remains in contact with the second fluid, the swelling step being performed in response to activating the first fluid to cause swelling of the first swellable material, wherein the activating step further comprises providing fluid communication between a first reservoir and the first swellable material, wherein the well tool further comprises a second reservoir and a second swellable material, and wherein the activating step further comprises providing fluid communication between the second reservoir and the second swellable material.

* * * * *